US006557909B2

(12) United States Patent
Morris

(10) Patent No.: US 6,557,909 B2
(45) Date of Patent: May 6, 2003

(54) MORTISE LOCK

(75) Inventor: Eric D. Morris, King of Prussia, PA (US)

(73) Assignee: Von Morris Corporation, East Norriton, PA (US)

( * ) Notice: Subject to any disclaimer, the term of this patent is extended or adjusted under 35 U.S.C. 154(b) by 0 days.

(21) Appl. No.: 10/219,140

(22) Filed: Aug. 15, 2002

(65) Prior Publication Data

US 2003/0061847 A1 Apr. 3, 2003

Related U.S. Application Data

(60) Provisional application No. 60/235,698, filed on Sep. 28, 2001.

(51) Int. Cl.[7] ..... E05C 1/12; E05B 63/00; E05B 63/08

(52) U.S. Cl. ..... 292/161.15; 70/461; 70/486; 70/107; 292/DIG. 60; 292/DIG. 61

(58) Field of Search ..... 70/461, 486, 107; 292/DIG. 61, DIG. 60, 336.5, 169, 169.15, 169.16, 169.21, 170

(56) References Cited

U.S. PATENT DOCUMENTS

| | | | | | |
|---|---|---|---|---|---|
| 843,607 | A | * | 2/1907 | Hurd | 70/134 |
| 1,171,264 | A | * | 2/1916 | Shaw | 70/470 |
| 1,290,439 | A | * | 1/1919 | Weller | 70/107 |
| 1,688,472 | A | * | 10/1928 | Shaw | 292/169.19 |
| 2,029,991 | A | * | 2/1936 | Eichel, Jr. | 70/107 |
| 3,950,974 | A | | 4/1976 | Alexander | |
| 4,071,270 | A | * | 1/1978 | Alexander | 292/169.22 |
| 4,118,056 | A | | 10/1978 | Alexander | |
| 4,145,259 | A | * | 3/1979 | Leumann | 202/248 |
| 4,322,101 | A | * | 3/1982 | Kelly et al. | 292/260 |
| 4,481,796 | A | | 11/1984 | Hamme | |
| 4,572,556 | A | | 2/1986 | Foshee | |
| 4,641,866 | A | * | 2/1987 | Haeck et al. | 292/336.3 |
| 4,695,082 | A | | 9/1987 | Marks | |
| 5,678,870 | A | | 10/1997 | Pelletier | |
| 5,765,883 | A | * | 6/1998 | Dessenberger et al. | 292/92 |
| 6,250,119 | B1 | | 6/2001 | Flon | |
| 6,282,929 | B1 | | 9/2001 | Eller et al. | |

OTHER PUBLICATIONS

Eric D. Morris, "Statement of Eric D. Morris", Oct. 15, 2002.

* cited by examiner

*Primary Examiner*—Anthony Knight
*Assistant Examiner*—Michael J. Kyle
(74) *Attorney, Agent, or Firm*—Caesar, Rivise, Bernstein, Cohen & Pokotilow, Ltd.

(57) ABSTRACT

A mortise lock is provided which includes a casing having a front plate for confronting a door frame and a pair of opposed side walls, the front plate having an opening for a latch bolt. A latch bolt is movable with respect to the casing between an extended position and a retracted position by a linkage connected to a hub to receive a door handle shaft, the latch bolt is rotatable axially, and the hub is rotatably secured between the opposed side walls of the casing. A slider plate for initiating movement of the linkage is provided that is movable from a first position wherein the linkage moves the latch bolt to the retracted position to a second position wherein the linkage moves the latch bolt back to the extended position. The slider plate has a preset adjuster, adjustable through at least one access aperture in the casing. An adjustable spring is included to urge the slider plate in a direction away from the hub to cause the slider plate to move to the second position and an access aperture is included in the casing to facilitate access to the adjustable spring.

16 Claims, 5 Drawing Sheets

MORTISE LOCK

CROSS REFERENCE TO RELATED APPLICATION

This application claims the benefit of U.S. Provisional Application Ser. No. 60/325,698, entitled Mortise Lock, filed on Sep. 28, 2001.

BACKGROUND OF THE INVENTION

Mortise locks are typically designed to fit into an opening provided in the edge of a door opposite the edge that is hinged to the door frame. The lock generally includes a latch bolt movable between an extended position (where the latch bolt projects beyond the edge of the door into an opening in the door frame to latch the door closed) and a retracted position (where the latch bolt is in position to permit opening of the door). Mortise locks also typically include a dead bolt that is movable between an extended position (where the dead bolt projects beyond the edge of the door into an opening in the door frame to lock the door) and a retracted position (where the dead bolt permits opening of the door). Mortise locks are typically configured so that the inner door knob can be rotated to retract the latch, and the outer door knob can be rotated to retract the latch.

A door may be hinged to a door frame along its left side edge or its right side edge. A conventional mortise lock mounted in the left edge of a door must be reversed when the lock is mounted in the right side edge of a door so that the inner and outer door knobs of a left-side mounted lock become the outer and inner door knobs, respectively, of a right-side mounted lock. Thus, adjustments must be made to the conventional mortise lock depending on whether it is mounted in a left-side or right-side orientation.

Adjustments to the conventional mortise lock are typically accomplished by partially or totally disassembling the mortise lock and rearranging or configuring the mortise lock components to achieve the desired mode of operation. However, the task of disassembling the mortise lock is a time consuming process. Furthermore, disassembling the mortise lock provides opportunities for damaging the lock components. Additionally, components may become lost during the adjustment process. If replacement components are not available, the mortise lock will have to be replaced.

U.S. Pat. No. 4,695,082 discloses a reversible mortise lock in which its housing need not be opened in order to reverse the door knob operation, so that one knob or the other is optionally prevented from retracting the latch.

Likewise, U.S. Pat. No. 5,678,870 discloses a reversible mortise lock that does not have to be opened and components need not be removed from the mortise lock in order to reverse the door knob operation.

A typical mortise lock uses a cam shaped hub working through several plates and levers to retract the latch bolt against spring tension. There are usually two or more springs used in a mortise lock. One spring serves to keep the latch fully extended. This is typically a relatively soft spring. In addition, there are typically one or more other springs that serve to hold a pair of levers in a horizontal position, or keep a pair of knobs in the correct orientation. Differing degrees of spring tension are required for levers and knobs.

A pair of levers requires a strong spring to support the weight of the levers which are cantilevered from the spindle centerline. The levers also require a strong spring because pressure is applied to the levers at a distance of, e.g., abut 2½ inches from the spindle centerline. In order to provide a comfortable feel for the levers, relatively stronger springs are required.

Knobs require a softer spring because knob diameters rarely exceed 2¼ inches. This results in a lever arm of just 1⅛ inches. This shorter lever arm develops less leverage when retracting the latch bolt. In order to provide for a comfortable feel, relatively soft springs are used. In addition, because the knobs are balanced on both sides of the spindle, there is no weight cantilevered on one side of the spindle and there is no weight to be supported by these springs.

A problem with past mortise locks is that there is a lack of adjustability for the springs in the latch bolt retraction system to provide for use of either or both knobs and levers in the mortise lock such that the mortise lock does not have to be opened and components need not be removed from the mortise lock.

Since a typical mortise lock can be installed in one of two basic orientations (dead bolt up or dead bolt down), the door hubs must rotate in two directions. As indicated above, when levers, rather than a round door knob, are used with a mortise lock, they put pressure on the spring or springs associated with their hub. Springs will, over time, lose some ability to apply a force. This allows the levers to "sag". To combat the impression of "sag," many lock manufacturers will introduce a small amount of "preset" by slightly rotating the square hole in their latch hubs. But, since a typical mortise lock allows for installation and therefore rotation in two directions, this would require the consumer to disassemble the lock to reverse the hub when installing the lock. Again, this often leads to the customer losing parts and additional difficulties as described above. It would therefore be desirable to provide an apparatus that enables "preset" to be changed without disassembling the lock.

BRIEF SUMMARY OF THE INVENTION

A mortise lock is provided which includes a casing having a front plate for confronting a door frame and a pair of opposed side walls, the front plate having an opening for a latch bolt. A latch bolt is movable with respect to the casing between an extended position and a retracted position by a linkage connected to a hub to receive a door handle shaft, the latch bolt is rotatable axially, and the hub is rotatably secured between the opposed side walls of the casing. A slider plate for initiating movement of the linkage is provided that is movable from a first position wherein the linkage moves the latch bolt to the retracted position to a second position wherein the linkage moves the latch bolt back to the extended position. The slider plate may have a preset adjuster, adjustable through at least one access aperture in the casing. An adjustable spring may be included to urge the slider plate in a direction away from the hub to cause the slider plate to move to the second position and an access aperture is included in the casing to facilitate access to the adjustable spring.

The linkage may include a latch body carrier having a latch bolt spring guide and a latch bolt spring held in place by a latch bolt spring retainer, and a latch actuation lever connected between the slider plate by at least one pivot pin.

The hub may have a main body and a first and a second hub wing extending from the main body. Here, the slider plate has an upper member or block and a lower member or block, the upper member having an adjustable portion thereon to adjust preset in one direction. The adjustable portion is adapted to contact the first hub wing when the hub is rotated in a counterclockwise direction. The lower member has a second adjustable portion thereon to adjust preset in another direction, the second adjustable portion adapted to contact the second hub wing when the hub is rotated in a clockwise direction. Rotation of the hub in either a clockwise or counterclockwise direction causes substantially identical movement of the slider plate to cause the latch bolt to retract and extend. At least one spring is used to urge the slider plate in a direction away from the hub to cause the slider plate to move to the second position. Preferably, the adjustable portions are accessible for adjustment through the casing. The linkage preferably includes a latch body carrier having a latch bolt spring guide and a latch bolt spring held in place by a latch bolt spring retainer, and a latch actuation lever connected between the slider plate by at least one pivot pin.

An adjustable spring may be provided to urge the slider plate in a direction away from the hub to cause the slider plate to move to the second position. An access aperture in the casing is preferably provided to facilitate adjustment of the adjustable spring.

The adjustable spring may include a floating spring adjuster plate having a threaded hole therein, a spring adjusting screw to be received between the threaded hole and the casing and at least one spring between the floating spring adjuster plate and the slider plate. Rotation of the screw within the threaded hole through the access aperture causes the distance between the spring adjuster plate and the front plate of the housing to change. Preferably, the spring is a pair of concentric coil springs where one spring is shorter than the other spring. Alternatively a spring having a nonlinear spring rate may be used.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
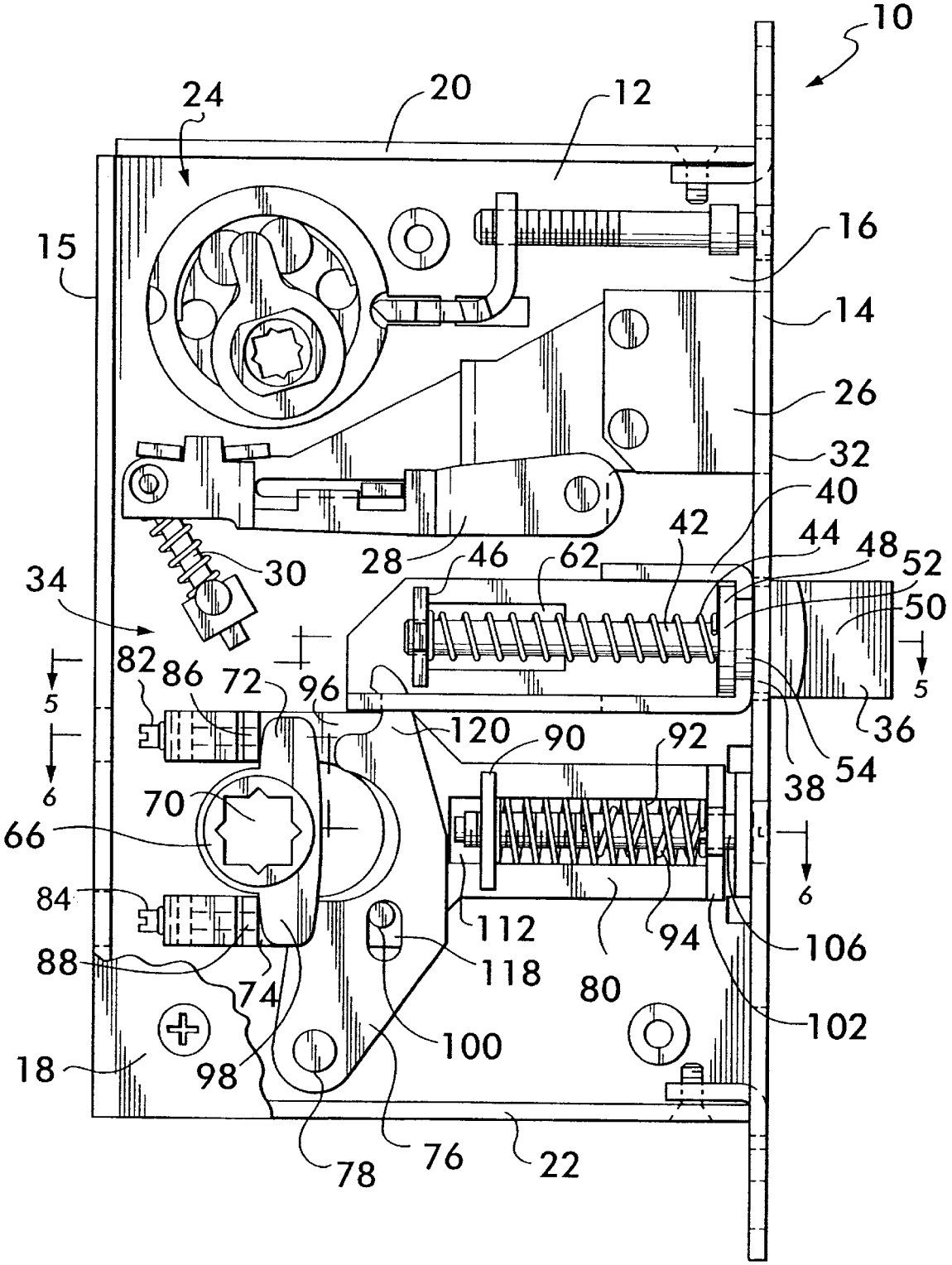
FIG. 1 is a front elevation, partially cutaway view of a mortise lock in accordance with one preferred embodiment of the present invention.

Referring now to the drawings, wherein like part numbers refer to like elements throughout the several views, there is shown in FIG. 1 a mortise lock 10 in accordance with one preferred embodiment of the present invention. The mortise lock 10 includes a casing 12 within which the lock components are enclosed. The casing 12 includes a front plate 14, opposed side walls 16, 18, a top wall 20 and a bottom wall 22. The front plate 14 confronts a door frame, as described below.

The mortise lock 10 can be installed either in the orientation shown in the figures with the dead bolt 26 on top (i.e., above the latch bolt 36) or flipped such that the dead bolt 26 is on the bottom (i.e., below the latch bolt 36). Details related to this feature will be discussed below. For purposes of convenience and clarity, the geometry of the mortise lock 10 will be described with the dead bolt 26 at the top.

The mortise lock 10 further includes a dead bolt mechanism 24 which includes the dead bolt 26, dead bolt bracket 28 and dead bolt arm 30. Dead bolt 26 is movable within opening 32 in front plate 14 and between a locked position and an unlocked position. When dead bolt 26 is in the locked position, dead bolt 26 projects from the casing 12 through opening 32 in front plate 14. When dead bolt 26 is in the unlocked position, dead bolt 26 is substantially completely withdrawn into the casing 12. It is noted that, for purposes of the present invention, substantially any suitable deadbolt mechanism known in the art of mortise locks of this general type may be used.

Figure 2:
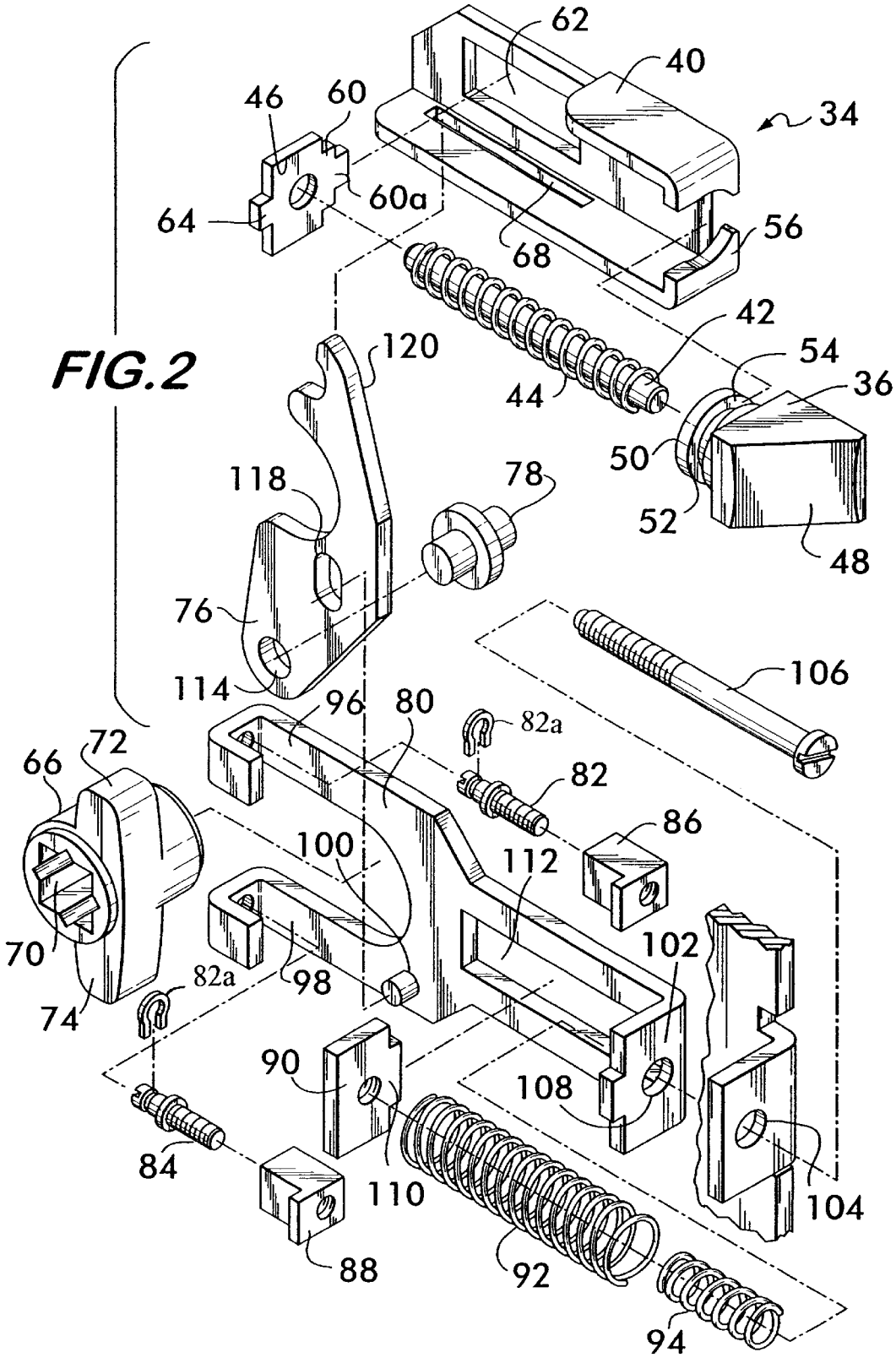
FIG. 2 is an exploded perspective view of the latch bolt mechanism of the mortise lock of FIG. 1.
Figure 3:
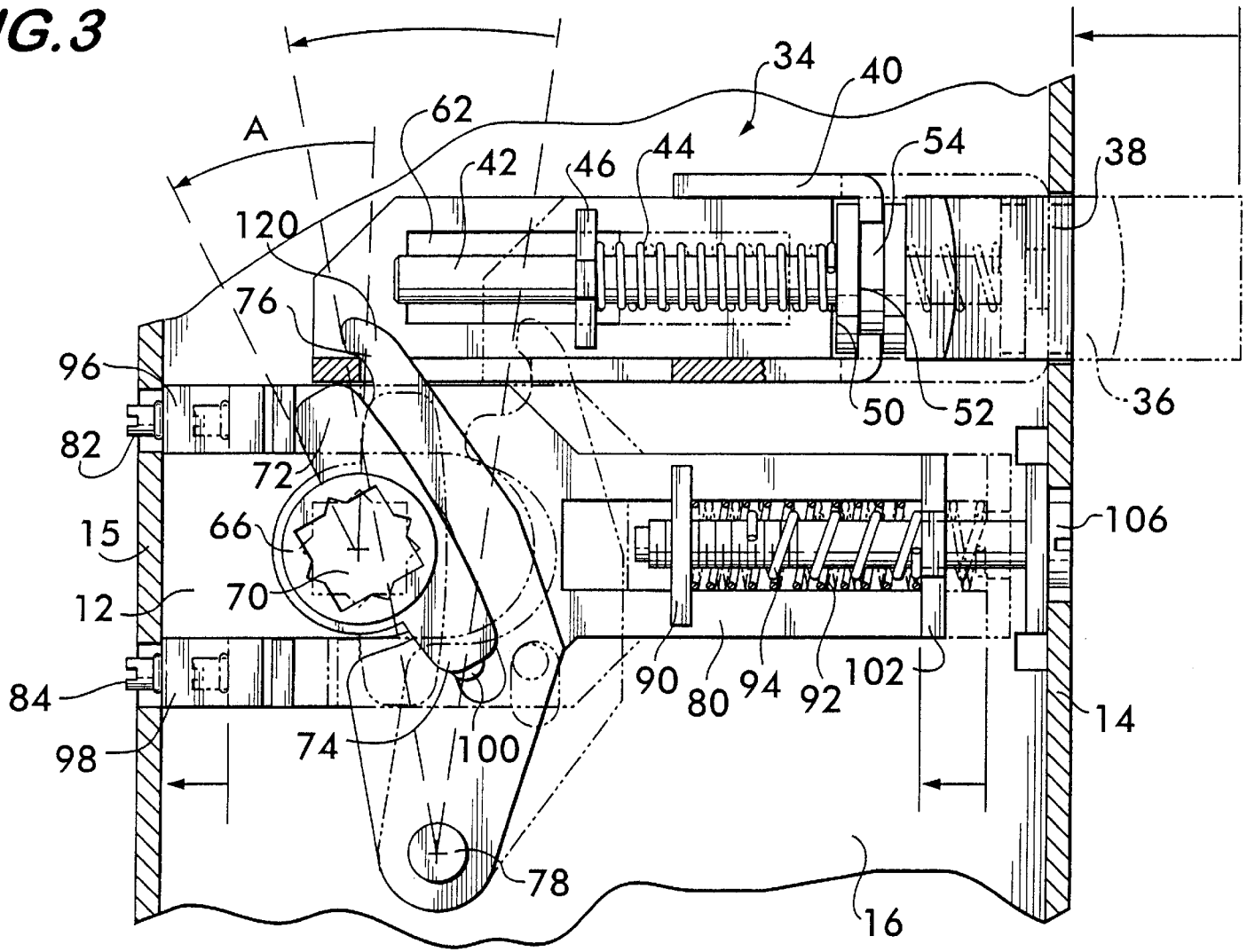
FIG. 3 is an enlarged, partial, side elevational view of the latch bolt mechanism of the mortise lock of FIG. 1 depicting the latch bolt in its retracted position and depicted with the latch bolt in its extended position in phantom lines with its hub rotated in a counterclockwise direction.
Figure 4:
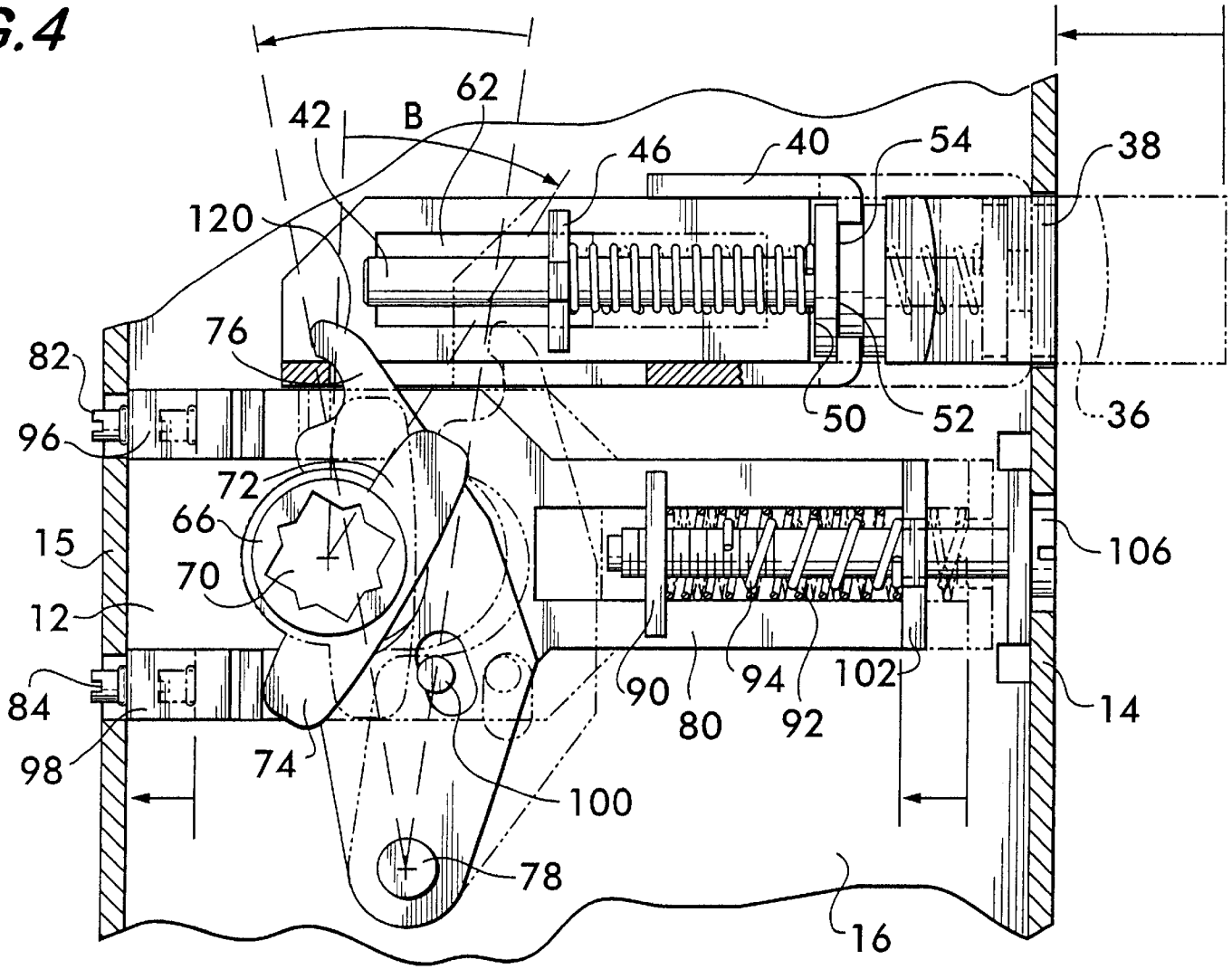
FIG. 4 is an enlarged, partial, side elevational view of the latch bolt mechanism of the mortise lock of FIG. 1 depicting the latch bolt in its retracted position and depicted with the latch bolt in its extended position in phantom lines with its hub rotated in a clockwise direction.

Referring now to FIG. 1 and more specifically to FIGS. 2–4, the present invention further includes latch bolt mechanism 34. Latch bolt mechanism 34 generally includes a latch bolt 36, movable within an opening 38 in front plate 14 and between an extended and retracted position. FIGS. 3 and 4 depict latch bolt 36 in the retracted position in solid lines, and in the extended position in phantom lines. When latch bolt 36 is in the extended position, latch bolt 36 projects from casing 14 through opening 38. When latch bolt 36 is in the retracted position, latch bolt 36 is substantially completely withdrawn into casing 12.

The latch bolt mechanism 34 further includes a linkage including a latch body carrier 40, a latch bolt spring guide 42, a latch bolt spring 44, and a latch bolt spring retainer 46. The linkage also includes a latch actuation lever 76, and pivot pins to be described below. As described above, the front plate 14 allows clearance for the latch bolt 36 to extend and retract from the casing 12 through a rectangular latch bolt opening 38 in the front plate 14.

Movement of the latch bolt 36 from the extended position to the retracted position can be accomplished in two ways. First, force can be applied to the latch bolt itself, for example, when a door to which the mortise lock 10 is attached is closed causing the latch bolt 36 to be forced to its retracted position when it meets a strike plate on a door jam. Second, movement of the latch bolt 36 can be accomplished by rotating a door handle that is attached to a hub in the mortise lock 10.

Figure 5:
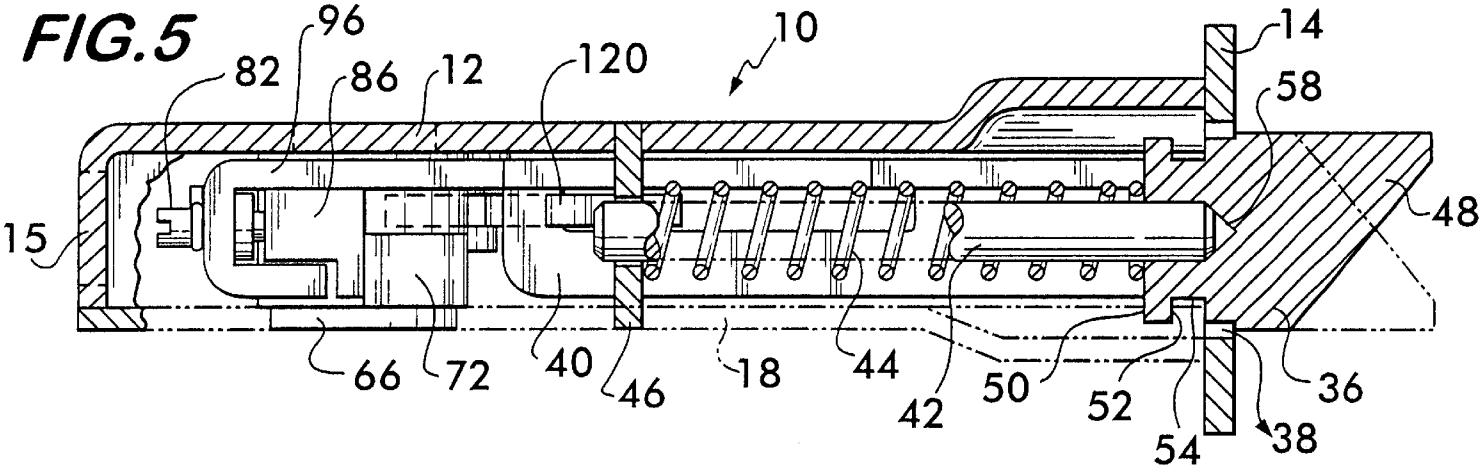
FIG. 5 is a cross-sectional view of the mortise lock of FIG. 1, taken substantially along lines 5—5 of FIG. 1.

First, movement caused by force applied to the latch bolt itself will be addressed. As can be seen in FIGS. 2 and 5, the latch bolt has a cam end 48 and a flange end 50. The flange end 50 includes a flange 52 preferably in the form of a cylinder integral to the latch bolt 36 about which is incorporated a groove 54. The latch bolt 36 is matable to the latch body carrier 40 in that a latch bolt flange receptacle 56 receives the latch bolt flange 48 about the groove 54 such that the latch bolt 36 is rotatable about its longitudinal axis within the flange receptacle 56, but relative longitudinal movement of the latch bolt 36 with respect to the latch body receptacle is substantially precluded.

As can be seen in FIG. 5, the latch bolt 36 includes an aperture 58 to receive the latch bolt spring guide 42. Coil spring 44 surrounds the spring guide 42 and is held in place between the latch bolt 36 and the latch bolt spring retainer 46. Spring retainer 46 is rigidly held by tab extensions 60*a* and 64 (see FIG. 2) with respect to the casing 12 by mating with closely fitting apertures (not shown) in the casing 12.

Tab 60 of the latch bolt spring retainer 46 is slidably received by a rectangular aperture 62 (see FIGS. 1 and 2) in the latch body carrier 40, allowing the latch bolt 36 along with the latch body carrier 40 to move axially in one direction (to the left in FIG. 1). When the latch bolt 36 is moved from its extended position to its retracted position by a force directed to the latch bolt 36 itself (rather than through rotation of hub 66 by a door handle, as will be explained in detail below), the latch body carrier 40 moves from a position where the latch bolt flange receptacle 56 (see FIG. 2) of the latch body carrier 40 moves from a position adjacent the front plate 14 to a second position within the casing. Slot 68 in the latch body carrier 40 allows the remaining elements of the latch bolt mechanism 34 to be unaffected by movement of the latch bolt 36 by a force directed to its cam end 48. That is, movement of the latch bolt 36 by a force on the cam end 48 of the latch bolt 36 causes movement of only the latch body carrier 40, the latch bolt spring 44, and the latch bolt spring guide 42, but clearance is provided for a pawl 120 on the remaining mechanism. The spring 44 causes the latch bolt 36 to always be biased towards its extended position. Different biasing devices for the urging the latch bolt 36 to its extended position are also intended to be within the scope of this invention, including, for example, one or more leaf springs, flat springs, resilient washers, and the like.

As can be seen in FIGS. 1, 2 and 5, it is noted that the geometry of the latch bolt flange 52 with respect to the latch bolt opening 38 and the latch bolt flange receptacle 56 of the latch body carrier 40 allow the latch bolt 36 to be rotated from a position where the cam surface of the latch bolt 36 is facing one opposed side 16 wall to a position facing the other opposed side wall 18, allowing the reversibility as described above.

Second, movement of the latch bolt 36 from the extended position to the retracted position by means of rotating the hub 66 (via a handle) will be addressed. As best seen in FIGS. 1 and 2, numerous additional elements of the latch bolt mechanism 34 now come into use, including the hub 66, a latch actuation lever 76, a pivot pin 78, a slider plate 80, a pair of adjuster screws 82, 84, a pair of adjuster blocks 86, 88, a spring adjuster plate 90, and a long spring 92 and a short spring 94 concentric to one another.

Hub 66 has a keyed aperture 70 adapted to receive the shaft of, for example, a door knob or door lever (not shown). As can be seen in FIG. 1, hub 66 has a generally circular main body and is rotatably secured in place within the casing 12 by hub apertures within the casing such that the hub 66 is rotatable about the axis of a mating door knob shaft. As can best be seen in FIGS. 1 and 3, rotation of the hub 66 in a counterclockwise direction A (see FIG. 3), causes a hub wing 72 extending from the main body of the hub 66 to drive the slider plate 80 via upper slider plate leg 96 and upper adjuster block 86 to the left. Likewise rotation of the hub in a clockwise direction B, as can be seen in FIG. 4, causes hub wing 74 extending from the main body of the hub 66 to drive the slider plate 80 via lower slider plate leg 98 and lower adjuster block 88 to the left. Therefore, clockwise or counterclockwise movement causes identical movement of the slider plate 80.

Figure 6:
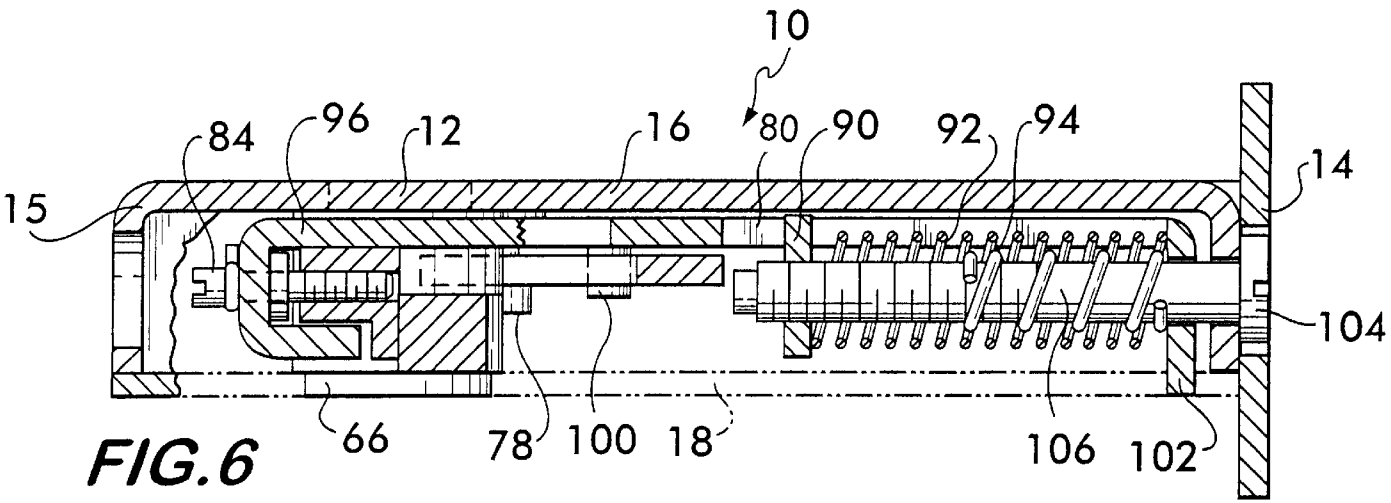
FIG. 6 is a cross-sectional view of the mortise lock of FIG. 1, taken substantially along lines 6—6 of FIG. 1.

As best seen in FIG. 6, the slider plate 80 is biased to the right by the pair of concentric coil springs 92, 94 held between a spring tab 102 on the slider plate 80 and spring adjuster plate 90. Spring adjusting screw 106 is secured between the casing 12 and the spring adjuster plate 90. Casing 12 has a clearance hole 104 (see FIG. 2) to receive the shaft of the screw 106, but not its head. Likewise, slider plate clearance hole 108 (see FIG. 2) provides clearance for the shaft of screw 106. The shaft of the screw 106 then extends through short spring 94 and long spring 92 which are concentric to one another and is secured, via threads in the shaft of the screw 106, to the spring adjuster plate 90. Spring adjuster plate 90 abuts an end of either one or both of the long spring 92 and short spring 94 and contains a spring adjuster plate tab 110 (see FIG. 2) that provides for limited left to right movement within rectangular slider plate aperture 112. Adjustment of the spring tension with respect to rotation of the hub 66 is accomplished by providing increased biasing of the slider plate 80 to the left by rotation of spring adjusting screw 106 causing the spring adjuster tab 110 to move to the right within the slider plate aperture along the axis of the screw 106.

When the spring adjuster plate 90 is adjusted to the extreme end of the spring adjusting screw 106, only the long spring 92 is engaged and the spring tension is low. When the spring adjuster plate 90 is adjusted closer to the head of the spring adjusting screw 106, both springs 92, 94 are engaged and the spring rate is increased. The result is higher effort required to retract the latch bolt 36 when rotating the hub 66. A spring having a nonlinear spring rate would also function appropriately. Additionally, any suitable type of spring or springs is within the intended scope of this invention, including leaf springs, flat springs, resilient washers, and the like.

As shown in FIGS. 1 and 2, it has been found that binding of the concentric springs wound in the same direction may occur. Therefore it is preferable that the two springs 92, 94 be wound counter to one another.

The elements providing movement of the latch bolt 36 based on movement of the hub 66 will now be described. Latch actuation lever 76 includes a round aperture 114 to receive the pivot pin 78 which is held in an aperture in the casing 14 (see FIG. 1). Latch actuation lever 76 also includes a slot-shaped aperture 118 that receives a slider plate pin 100 integral to the slider plate 80, adjacent its lower leg 98. As can be seen in FIGS. 3 and 4, movement of the slider plate 80 to the left by clockwise or counterclockwise rotation of the hub 66 (as described above) causes the latch actuation lever 76 to rotate in a counterclockwise direction about pivot pin 78. The slider plate pin 100, within the latch actuator lever slot-shaped aperture 118, urges the latch actuation lever 76 lever counterclockwise. The latch actuation lever 76 has a pawl 120 which extends into the slot 68 (see FIG. 2) of the latch body carrier 40. Therefore, counterclockwise movement of the latch actuation lever about pivot pin 78, caused by rotational movement of the hub 66, urges the latch body carrier 40 to the left and therefore the latch bolt 36 to retract.

As described previously the mortise lock 10 can be installed with the deadbolt 26 in either the top or bottom position. This requires the hub 66 to rotate in two directions. When levers, rather than a round door knob, are used with any lock, they put pressure on the spring or springs associated with their hub. Springs will, over time, lose some of their tension. This allows the levers to sag. To combat sag, "preset" may be used, by slightly rotating the hub 66. But, since the mortise lock 10 here allows for installation and therefore rotation in two directions, this would require the consumer to disassemble the lock to reverse the hub when installing the lock. This often leads to the customer losing parts.

The present invention includes an apparatus that enables "preset" to be changed without disassembling the lock. The slider plate 80 carries two adjuster blocks 86, 88 attached to the upper slider plate leg 96 and lower slider plate leg 98 respectively. The adjuster blocks 86 and 88 are secured to the legs 96, 98 by hub adjustor screws 82, 84 secured to the legs 96, 98 by clips 82*a*. By unscrewing, through apertures in the back wall 15 of the casing 12, one of the adjustor screws 82, 84 the corresponding adjustor block 86 or 88 moves away from the slider plate 80 and causes the hub 66 to rotate clockwise or counterclockwise, depending upon which screw 84, 86 is selected. A limited amount of preset may therefore be created by rotating the appropriate adjustor screw 82, 84.

While the invention has been described in detail and with reference to specific examples thereof, it will be apparent to one skilled in the art that various changes and modifications can be made therein without departing from the spirit and scope thereof.

I claim:

1. A mortise lock, comprising:

a) a casing having a front plate for confronting a door frame and a pair of opposed side walls, said front plate having an opening for a latch bolt;

b) a latch bolt movable with respect to said casing between an extended position and a retracted position by a linkage connected to a hub adapted to receive a door handle shaft, said latch bolt rotatable axially, said hub rotatably secured between said opposed side walls of said casing;

c) a slider plate for initiating movement of said linkage, movable from a first position wherein said linkage moves said latch bolt to the retracted position to a second position wherein said linkage moves said latch bolt back to the extended position, said slider plate having a preset adjuster, adjustable through at least one access aperture in said casing;

d) an adjustable spring to urge said slider plate in a direction away from said hub to cause said slider plate to move to said second position; and e) an access aperture in the casing to facilitate access to said adjustable spring.

2. The mortise lock of claim 1, wherein the linkage comprises a latch body carrier having a latch bolt spring guide and a latch bolt spring held in place by a latch bolt spring retainer, and a latch actuation lever connected between said slider plate by at least one pivot pin.

3. A mortise lock, comprising:

a) a casing having a front plate for confronting a door frame and a pair of opposed side walls, said front plate having an opening for a latch bolt;

b) a latch bolt movable with respect to said casing between an extended position and a retracted position by a linkage connected to a hub adapted to receive a door handle shaft, said latch bolt rotatable axially, said hub rotatably secured between said opposed side walls of said casing, said hub having a main body and a first and a second hub wing extending from said main body;

c) a slider plate for initiating movement of said linkage, movable from a first position wherein said linkage moves said latch bolt to the retracted position to a second position wherein said linkage moves said latch bolt back to the extended position, said slider plate having an upper member and a lower member, said upper member having an adjustable portion thereon to adjust preset in one direction, said adjustable portion adapted to contact said first hub wing when said hub is rotated in a counterclockwise direction, said lower member having a second adjustable portion thereon to adjust preset in another direction, said second adjustable portion adapted to contact said second hub wing when said hub is rotated in a clockwise direction, rotation of said hub in either a clockwise or counterclockwise direction causing substantially identical movement of said slider plate to cause said latch bolt to retract and extend; and d) at least one spring to urge the slider plate in a direction away from said hub to cause said slider plate to move to said second position.

4. The mortise lock of claim 3, wherein said adjustable portions are accessible for adjustment through the casing.

5. The mortise lock of claim 3, wherein the linkage comprises a latch body carrier having a latch bolt spring guide and a latch bolt spring held in place by a latch bolt spring retainer, and a latch actuation lever connected between said slider plate by at least one pivot pin.

6. A mortise lock, comprising:

a) a casing having a front plate for confronting a door frame and a pair of opposed side walls, said front plate having an opening for a latch bolt;

b) a latch bolt movable with respect to said casing between an extended position and a retracted position by a linkage connected to a hub adapted to receive a door handle shaft, said latch bolt rotatable axially, said hub rotatably secured between said opposed side walls of said casing, said hub having a main body and a first and a second hub wing extending from said main body;

c) a slider plate for initiating movement of said linkage, movable from a first position wherein said linkage moves said latch bolt to the retracted position to a second position wherein said linkage moves said latch bolt back to the extended position, and wherein rotation of said hub in either a clockwise or counterclockwise direction causes substantially identical movement of said slider plate to cause said latch bolt to retract and extend;

d) an adjustable spring to urge the slider plate in a direction away from said hub to cause said slider plate to move to said second position, and e) an access aperture in the casing to facilitate adjustment of said adjustable spring.

7. The mortise lock of claim 6, wherein said adjustable spring comprises a floating spring adjuster plate having a threaded hole therein, a spring adjusting screw to be received between said threaded hole and said casing and at least one spring between said floating spring adjuster plate and said slider plate, wherein rotation of said screw within said threaded hole through said access aperture causes the distance between said spring adjuster plate and said front plate of said housing to change.

8. The mortise lock of claim 7, wherein said at least one spring is a pair of concentric coil springs.

9. The mortise lock of claim 8, wherein said pair of concentric springs includes a first spring that is shorter than the second spring.

10. The mortise lock of claim 7, wherein said at least one spring is a spring having a nonlinear spring rate.

11. The mortise lock of claim 6, wherein the linkage comprises a latch body carrier having a latch bolt spring guide and a latch bolt spring held in place by a latch bolt spring retainer, and a latch actuation lever connected between said slider plate by at least one pivot pin.

12. A mortise lock, comprising:

a) a casing having a front plate for confronting a door frame and a pair of opposed side walls, said front plate having an opening for a latch bolt;

b) a latch bolt movable with respect to said casing between an extended position and a retracted position by a linkage connected to a hub adapted to receive a door handle shaft, said latch bolt rotatable axially, said hub rotatably secured between said opposed side walls of said casing, said hub having a main body and a first and a second hub wing extending from said main body;

c) a slider plate for initiating movement of said linkage, movable from a first position wherein said linkage moves said latch bolt to the retracted position to a second position wherein said linkage moves said latch bolt back to the extended position, said slider plate an upper slider plate leg and a lower slider plate leg, said upper slider plate leg having an adjustable block thereon to adjust preset in one direction, said adjustable block adapted to contact said first hub wing when said hub is rotated in a clockwise direction, said lower slider plate leg having a second adjustable block thereon to adjust preset in another direction, said adjustable block adapted to contact said second hub wings when said hub is rotated in a counterclockwise direction, rotation of said hub in either a clockwise or counterclockwise direction causing substantially identical movement of said slider plate to cause said latch bolt to retract and extend;

d) an adjustable spring to urge the slider plate in a direction away from said hub to cause said slider plate to move to said second position, said adjustable spring comprising a floating spring adjuster plate having a threaded hole therein, a spring adjusting screw to be received between said threaded hole and said casing and at least one spring between said floating spring adjuster plate and the slider plate, wherein rotation of said screw within said threaded hole causes the distance between said spring adjuster plate and said front plate of said housing to change; and e) an access aperture in the casing to facilitate adjustment of said spring adjusting screw;

whereby spring force on said slider plate is dependent upon positioning of said spring adjuster plate with respect to said front plate.

13. The mortise lock of claim 12, wherein said at least one spring is a pair of concentric coil springs.

14. The mortise lock of claim 13, wherein said pair of concentric springs includes a first spring that is shorter than the second spring.

15. The mortise lock of claim 12, wherein said at least one spring is a spring having a nonlinear spring rate.

16. The mortise lock of claim 12, wherein said adjustable blocks are accessible for adjustment through the casing.

* * * * *

UNITED STATES PATENT AND TRADEMARK OFFICE

CERTIFICATE OF CORRECTION

PATENT NO. : 6,557,909 B2
DATED : May 6, 2003
INVENTOR(S) : Eric D. Morris

It is certified that error appears in the above-identified patent and that said Letters Patent is hereby corrected as shown below:

Title page,
Item [60], Related U.S. Application Data, delete "60/235,698" and replace with -- 60/325,698 --.

Signed and Sealed this

Thirteenth Day of June, 2006

JON W. DUDAS
*Director of the United States Patent and Trademark Office*